US005456633A

United States Patent [19]

Choi

[11] Patent Number: 5,456,633

[45] Date of Patent: Oct. 10, 1995

[54] METHODS AND APPARATUS FOR ADJUSTING AIR FLOW CONTROLS LOUVERS

[75] Inventor: Kwi-Ju Choi, Suwon, Rep. of Korea

[73] Assignee: Samsung Electronics Co., Ltd., Suwon, Rep. of Korea

[21] Appl. No.: 260,906

[22] Filed: Jun. 15, 1994

[30] Foreign Application Priority Data

Jun. 17, 1993 [KR] Rep. of Korea ..... 93-11142

[51] Int. Cl.[6] ..... F24F 13/10

[52] U.S. Cl. ..... 454/256; 454/315; 454/319

[58] Field of Search ..... 424/155, 256, 424/285, 313, 315, 319, 320, 321, 202

[56] References Cited

U.S. PATENT DOCUMENTS 5,193,742 3/1993 Byun ..... 236/49.3
5,242,325 9/1993 Nukushina ..... 454/315 X
5,251,814 10/1993 Warashina et al. ..... 454/315 X

FOREIGN PATENT DOCUMENTS 247943 11/1991 Japan .
180504 7/1993 Japan ..... 454/256

*Primary Examiner*—Harold Joyce
*Attorney, Agent, or Firm*—Burns, Doane, Swecker & Mathis

[57] ABSTRACT

A method of and an apparatus for driving wind direction control louvers of an air conditioner, capable of accurately controlling the wind direction to be a desired direction by accurately driving a horizontally-extending control louver or a vertically-extending control louver adapted to control the wind direction of the air conditioner. The method includes a time measuring step for measuring the time taken for the control louver to be driven a predetermined amount, and a driving step for comparing the measured time obtained at the time measuring step with a reference time and increasing a drive force for the control louver when the measured time is more than the reference time while driving the control louver by a normal drive force when the measured time is not more than the reference time.

10 Claims, 5 Drawing Sheets

METHODS AND APPARATUS FOR ADJUSTING AIR FLOW CONTROLS LOUVERS

BACKGROUND OF THE INVENTION

1. Field of the Invention

The present invention relates to a method of and an apparatus for driving air flow (wind) direction control louvers of an air conditioner such as cooler, heater, air conditioner having both the cooling function and the heating function, air air cleaning function and the like. In particular, the present invention relates to a method of and an apparatus for driving wind direction control louvers, capable of accurately controlling the wind direction in a desired direction by accurately driving a horizontally-extending control louver or a vertically-extending control louver adapted to control the wind direction of an air conditioner.

2. Description of the Prior Art

Generally, air conditioners include a heating device for heating a cold air present in a room and supplying the heated air into the room again, and a cooling device for cooling a warm room air and supplying the cooled air into the room again. There has been also known an air conditioner having both the heating function and the cooling function. Recently, these air conditioners also have had a cleaning function for cleaning a contaminated room air and supplying the cleaned air into the room again.

Referring to FIG. 1, there is illustrated an indoor unit of a conventional air conditioner having a cooling function, namely, a cooling device (generally called "aircon"). In FIG. 1, the indoor unit is denoted by the reference numeral 10. Of course, the air conditioner also includes an outdoor unit not shown. In FIG. 1, the reference numeral 12 denotes an air inlet for introducing an air present into a room into the interior of the indoor unit 10. The reference numeral 14 denotes an air outlet for supplying the air cooled by a heat exchanger equipped in the indoor unit 10 into the room again. The heat exchanger will be described hereinafter, in conjunction with FIG. 2. On the other hand, the reference numerals 16 and 18 denote a horizontally-extending control louver and at least one vertically-extending control louver for controlling the direction of the air supplied into the room through the air outlet 14, respectively. The horizontal control louver 16 controls the vertical wind direction whereas the vertical control louver 18 controls the lateral wind direction.

FIG. 2 is an elevational view in section of the cooling device. In FIG. 2, elements corresponding to those in FIG. 1 are denoted by the same reference numerals. In FIG. 2, the reference numeral 20 denotes the heat exchanger. When the room air introduced into the interior of the indoor unit 10 passes through the heat exchanger 20, it comes into contact with heat exchanging fins of the heat exchanger 20, which are kept at a low temperature by a cold refrigerant flowing in the interior of heat exchanger 20, and thereby achieves a heat exchange with the refrigerant.

The reference numeral 22 denotes a fan which discharges the air cooled by the heat exchange achieved in the heat exchanger 20, into the room through the outlet 14.

FIG. 3 is a block diagram illustrating a control system for a control louver driving device employed in the above-mentioned conventional air conditioner. In FIG. 3, the reference numeral 30 denotes a drive selection panel 30 which is typically constituted by a key matrix. The drive selection panel 30 is adapted to convert a user's control command into a corresponding signal to be outputted. The reference numeral 32 denotes a control unit which generates a drive signal, based on the user's control command received from the drive selection panel 30. The reference numeral 34 denotes a fan driving unit which receives an appropriate drive signal from the control unit 32 and drives the winding fan 22 shown in FIG. 2, based on the received drive signal. The reference numeral 36 denotes a control louver driving unit which receives an appropriate drive signal from the control unit 32 and drives the control louvers, based on the received drive signal.

Each of the appropriate drive signals is a pulse signal having a predetermined frequency. On the other hand, the control louvers include the horizontal control louver 16 and the vertical control louver 18.

The control louver driving unit 36 includes a motor (not shown) adapted to be actuated by an appropriate drive signal generated from the control unit 32 to drive the control louvers. The motor may be a step motor which is typically employed in conventional air conditioners.

The air conditioner including the control louver driving device having the above-mentioned construction initiates its operation when the user pushes down a selected drive button of the drive selection panel 30.

When the air conditioner initiates its operation, the control unit 32 sends an appropriate drive signal to the fan driving unit 34 which, in turn, drives the fan 22, based on the received drive signal. As the fan 22 is driven, air present in the room is introduced into the interior of indoor unit 10 through the air inlet 12 and then heat-exchanged with the heat exchanger 20, so that it may be cooled. The cooled air is then continuously discharged through the air outlet 14 by the winding fan 22 to be introduced into the room again.

The control unit 32 also sends an appropriate motor drive signal to the control louver driving unit 36. The motor drive signal is a pulse signal having a predetermined frequency for actuating the step motor of the control louver driving unit 36. The step motor of the control louver driving unit 36 is driven or rotated by the pulse signal outputted from the control unit 32. By the driving of the step motor, the horizontal control louver 16 and/or the vertical control louver 18 are driven.

At this time, the air discharged out of the air outlet 14 by the fan 22 is introduced into the room while being controlled in direction by the horizontal control louver 16 and/or the vertical control louver 18.

In the above-mentioned conventional construction, however, the signal, namely, the pulse signal sent from the control unit 32 to the control louver driving unit 36 has a constant frequency. As a result, an accurate wind direction control meeting the user's desire may not be achieved when the control louvers are inaccurately driven in cases where they are bent due to an external influence such as a variation in temperature or where a foreign matter such as dust is caught in a gap defined by a rotation portion of each control louver. In other words, where the control louvers are bent or where a foreign matter such as dust is caught in each control louver, the load is increased. However, the torque of the step motor is constant without being varied in accordance with the increased load. This is because the frequency of the drive pulse signal outputted from the control unit 32 is always constant. Consequently, the control louvers may be inaccurately driven.

SUMMARY OF THE INVENTION

Therefore, an object of the invention is to solve the above-mentioned problems encountered in the prior art and, thus, to provide a method of and an apparatus for driving wind direction control louvers, capable of achieving an accurate control for the control louvers.

in accordance with one aspect, the present invention provides a method for driving a control louver of an air conditioner, comprising the steps of generating a predetermined drive signal from control means in accordance with a user's selection, and driving a motor and thus the control louver, based on the drive signal, thereby controlling the direction of a wind discharged out of an outlet of the air conditioner, the method further comprising: a time measuring step for measuring the time taken for the control louver to be driven a predetermined amount; and a driving step for comparing the measured time obtained at the time measuring step with a reference time and increasing a drive force for the control louver when the measured time is more than the reference time while driving the control louver by a normal drive force when the measured time is not more than the reference time.

In accordance with another aspect, the present invention provides an apparatus for driving a control louver of an air conditioner, comprising: drive selection means for converting a user's control command into a predetermined signal to be outputted; fan driving means for discharging an air, which has been introduced from a room in an indoor unit of the air conditioner and then subjected to an heat exchange in an indoor heat exchanger, into the room again; control louver driving means for driving the control louver and thereby controlling the direction of the air discharged into the room by the fan driving means; position sensing means disposed at a predetermined position on a trace along which the control louver moves, the position sensing unit serving to sense a movement of the control louver; and control means for sensing the movement condition of the control louver, measuring the time taken for the control louver to move a predetermined distance, comparing the measured time with a reference time, and controlling a drive force of the control louver driving means for the control louver on the basis of the result of the comparison.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
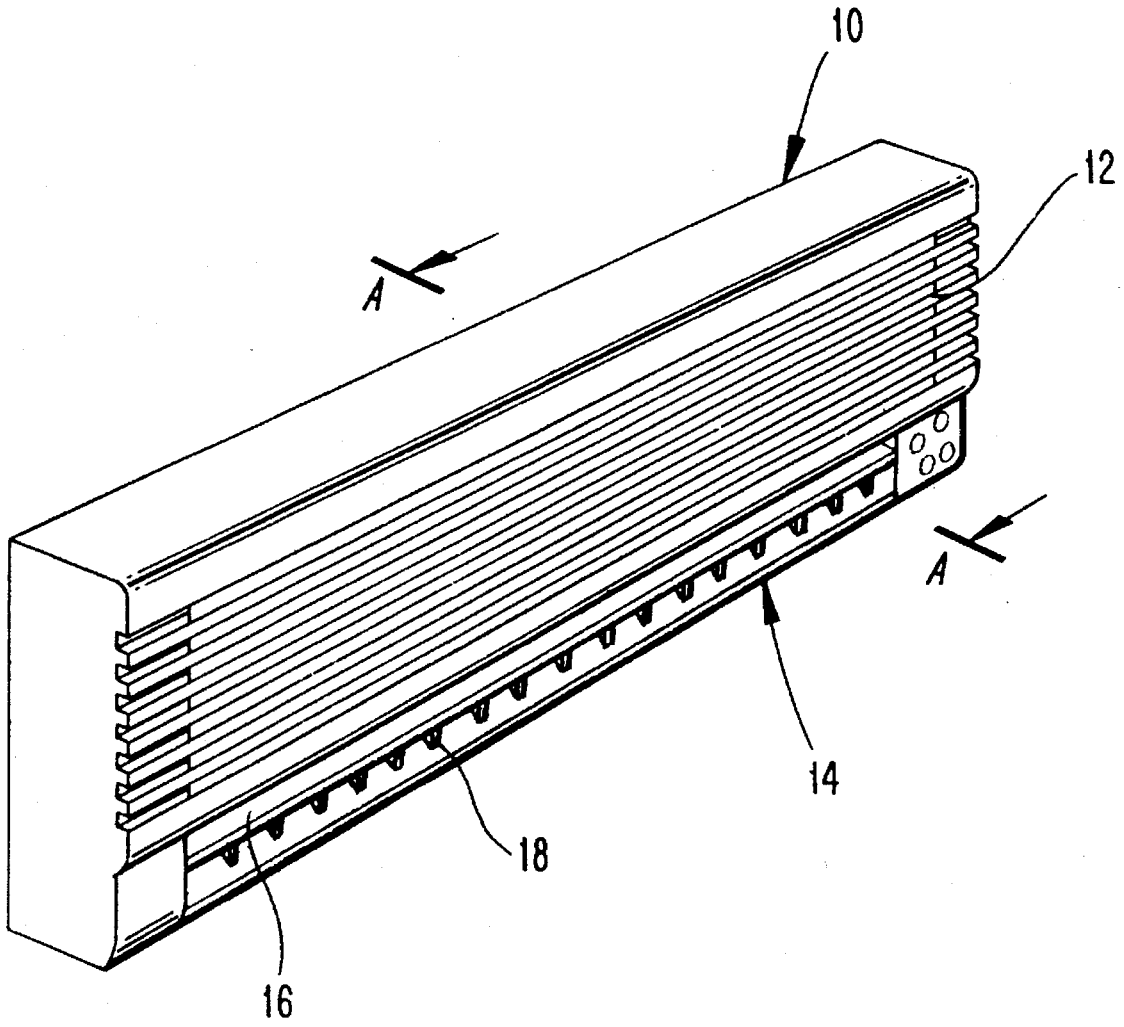
FIG. 1 (PRIOR ART)
FIG. 1 is a perspective view illustrating an indoor unit of a conventional air conditioner having a cooling function.
Figure 2:
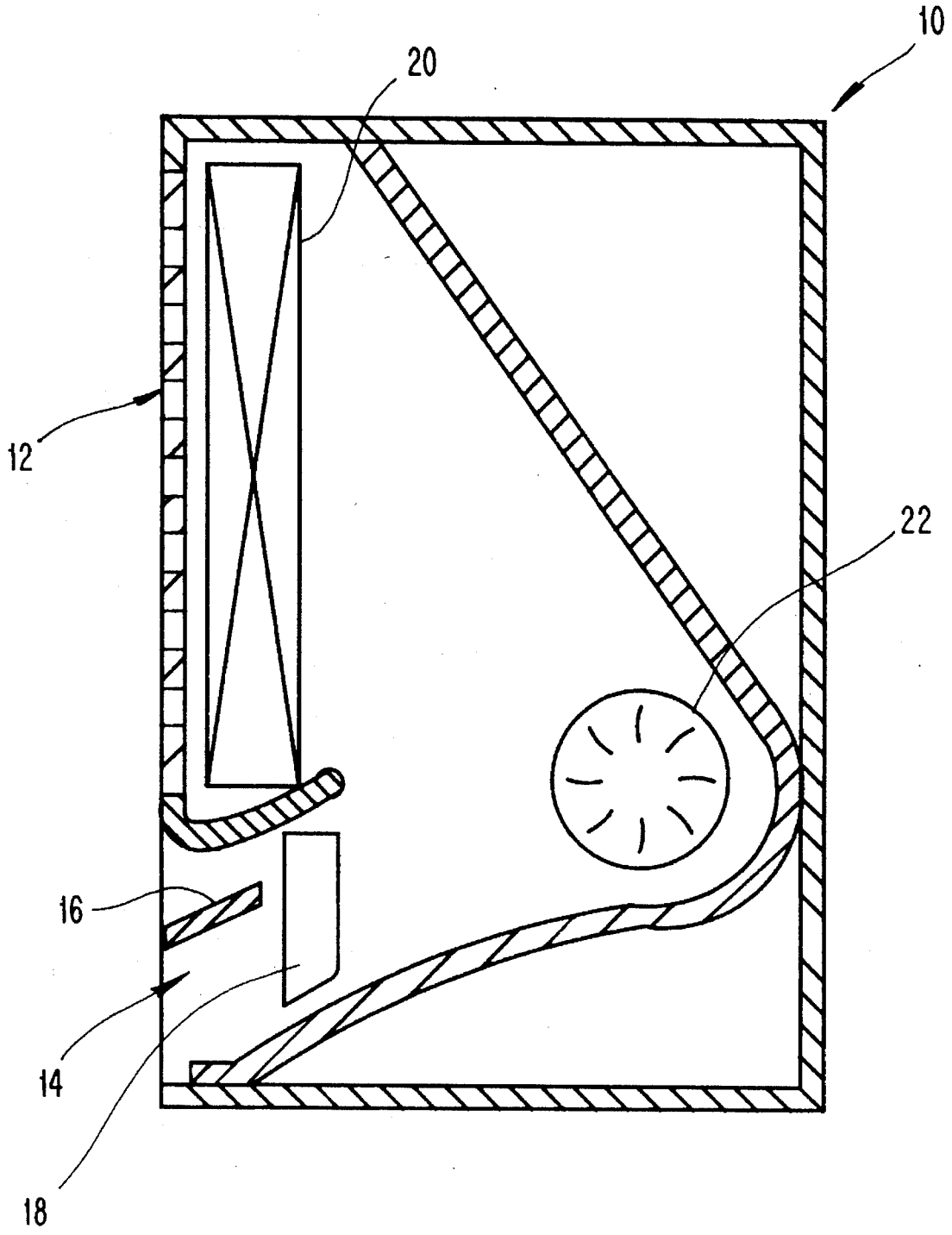
FIG. 2 (PRIOR ART)
FIG. 2 is an elevational view in section illustrating the air conditioner of FIG. 1.
Figure 3:
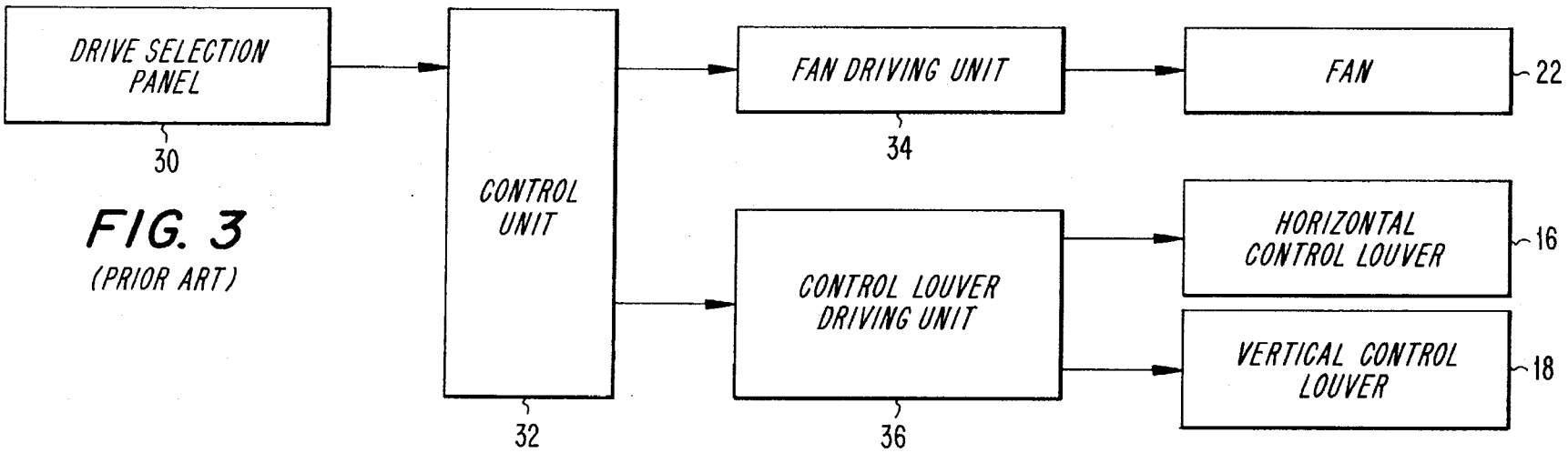
FIG. 3 (PRIOR ART)
FIG. 3 is a block diagram illustrating a control system for a control louver driving device employed in the conventional air conditioner.
Figure 4:
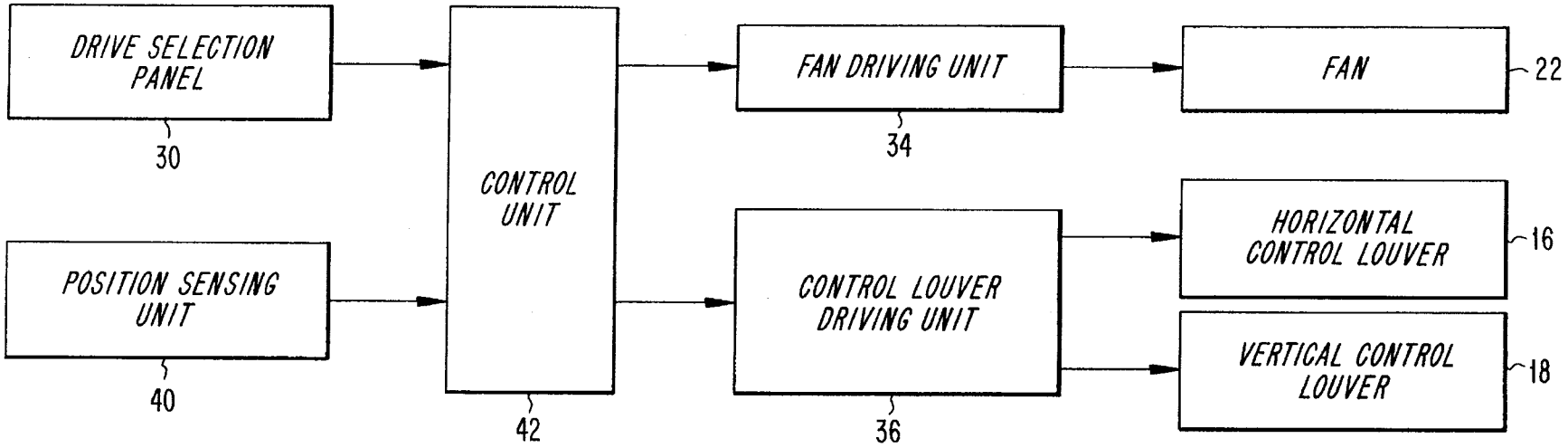
FIG. 4 is a block diagram illustrating a control system of an apparatus for driving wind direction control louvers of an air conditioner in accordance with the present invention.

FIG. 4 is a block diagram illustrating a control system of an apparatus for driving wind direction control louvers of an air conditioner in accordance with the present invention. In FIG. 4, elements corresponding to those in FIG. 3 are denoted by the same reference numerals.

In FIG. 4, the reference numeral 30 denotes a drive selection panel for converting a user's control command into a corresponding signal to be outputted. The reference numeral 34 denotes a fan driving unit for circulating air from a room, into an indoor unit of the air conditioner where it is subjected to an heat exchange in an indoor heat exchanger, and finally back into the room again. The reference numeral 36 denotes a control louver driving unit for driving control louvers including a horizontally-extending control louver and a vertically-extending control louver to control the direction of the air discharged into the room by the fan.

The reference numeral 40 denotes a position sensing unit disposed at a predetermined position on a trace along which a corresponding control louver moves. The position sensing unit 40 serves to sense a movement of the control louver. The reference numeral 42 denotes a control unit for measuring the time taken for the control louver to move a predetermined distance on the basis of the sensed movement condition. The control unit 42 compares the measured time with a reference time and controls a drive force of the control louver driving unit 36 for the control louver on the basis of the result of the comparison.

Figure 5:
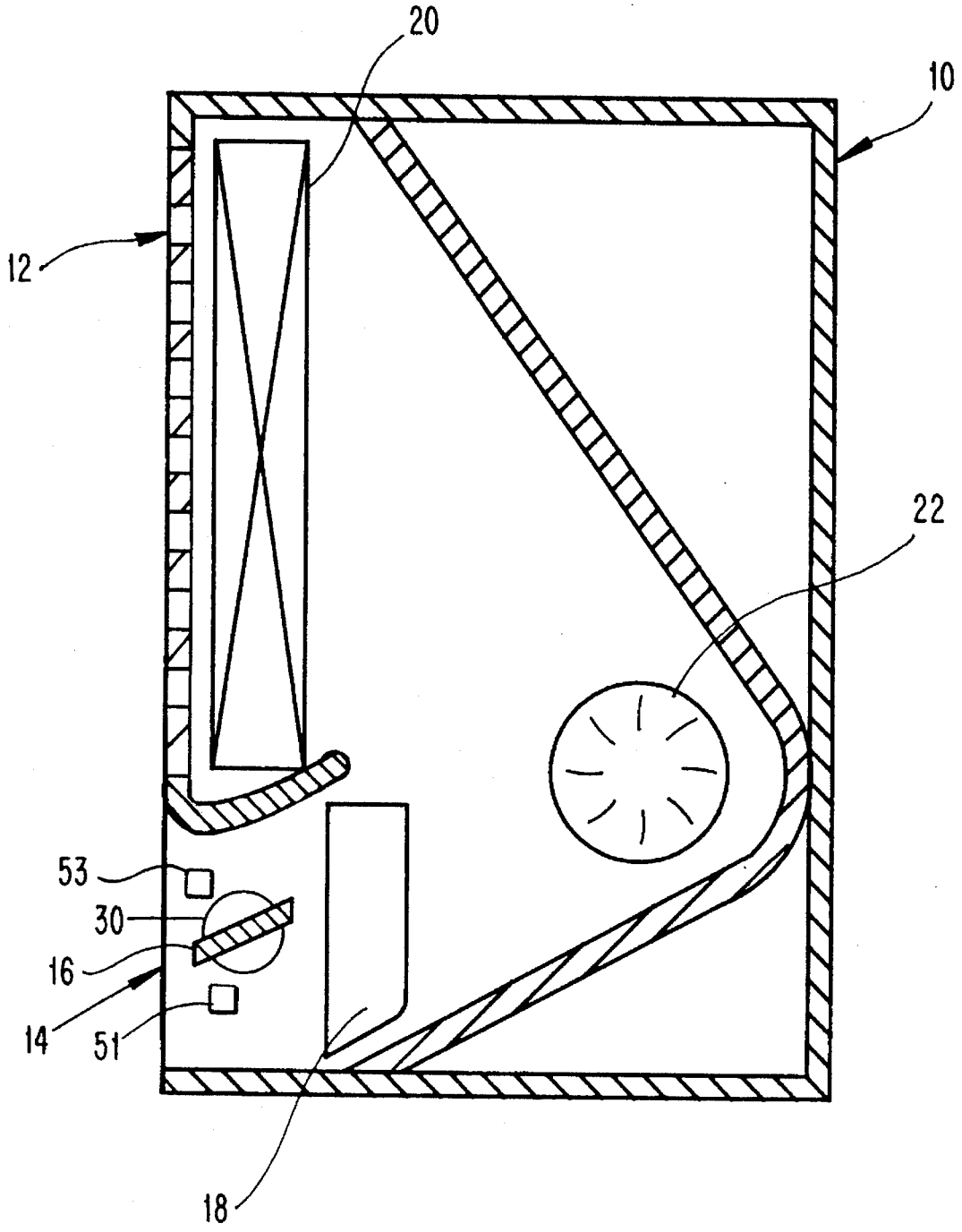
FIG. 5 is an elevational view in section illustrating an essential part of the air conditioner of FIG. 4 in an enlarged scale, for explaining an embodiment of the control louver driving apparatus in accordance with the present invention.

FIG. 5 is an elevational view in section showing an outlet 14 of the indoor unit in an enlarged scale, for explaining an embodiment of the control louver driving apparatus in accordance with the present invention.

Referring to FIG. 5, the horizontally-extending control louver 16 is disposed in front of the outlet 14 such that it can rotate vertically. In the rear of the horizontal control louver 16, at least one vertically-extending control louver 18 is disposed such that it can rotate laterally.

A pair of position sensors 51, 53 constituting the position sensing unit 40 are disposed above and beneath the horizontal control louver 16, respectively. That is, a first switch 51 serving as the upper position sensor is disposed above the horizontal control louver 16 whereas a second switch 53 serving as the lower position sensor is disposed beneath the horizontal control louver 16. The first and second switches 51 and 53 are arranged respectively at positions where they can be turned on being constructed by the horizontal control louver 16.

Figure 6:
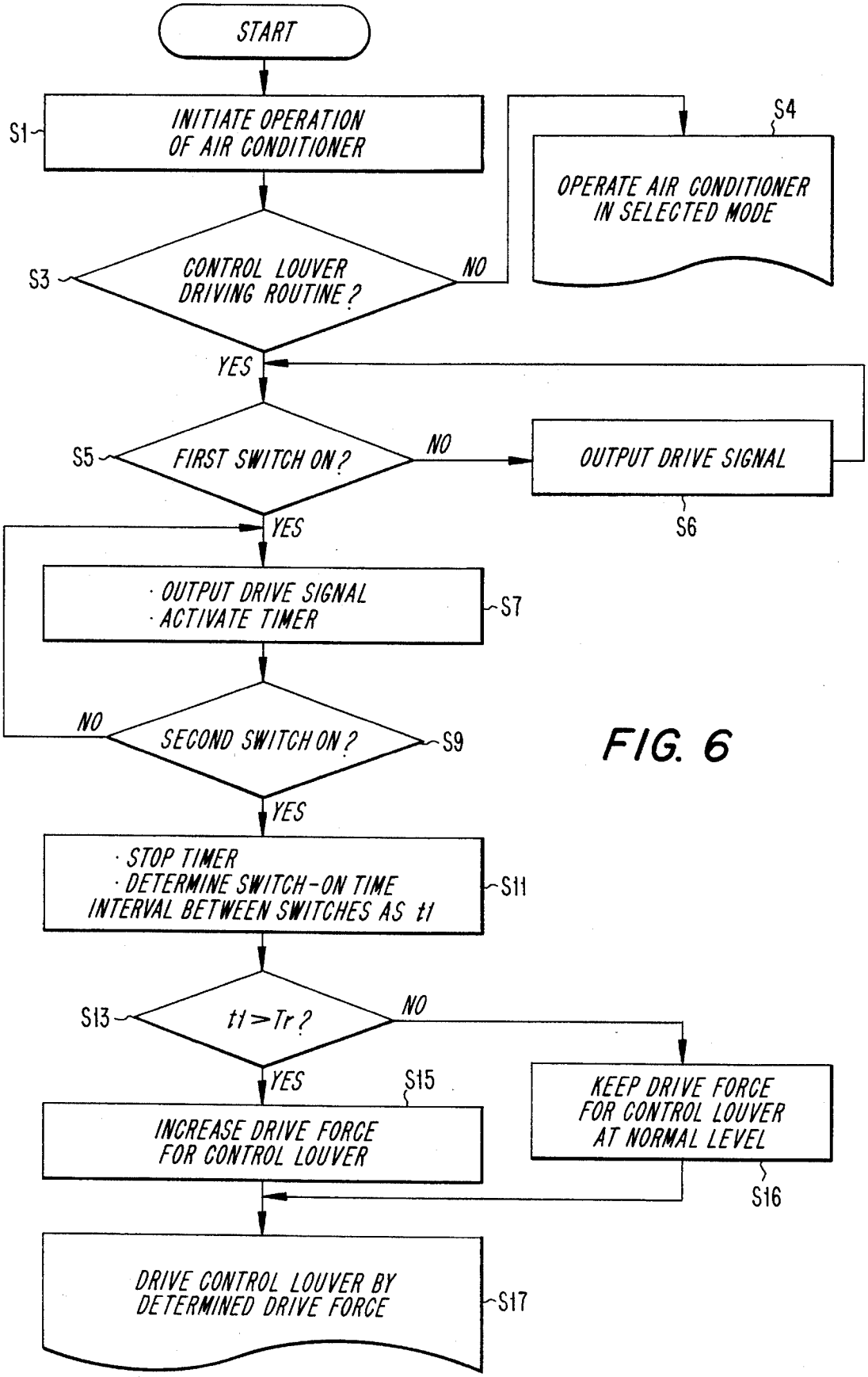
FIG. 6 is a flow chart illustrating a method for driving the wind direction control louver in accordance with the present invention.

FIG. 6 is a flow chart illustrating a method for driving the wind direction control louver in accordance with the present invention. In the illustrated case, the control louver is the horizontal control louver 16.

As shown in FIG. 6, the control louver driving method of the present invention comprises a time measuring step for measuring the time t1 taken for the control louver to be driven a predetermined distance, and a driving step for comparing the measured time t1 obtained at the time measuring step with a reference time Tr and increasing a drive force for the control louver when the measured time t1 is more than the reference time Tr while driving the control louver by a normal drive force when the measured time t1 is not more than the reference time Tr.

Now, the control louver driving operation in accordance with the embodiment of the present invention will be described in detail, in conjunction with FIGS. 4 to 6.

When the user manipulates the drive selection panel 30 to operate the air conditioner at a step S1, the control unit 42 generates an appropriate drive signal on the basis of an output signal from the drive selection panel 30 and sends it to the fan driving unit 34 which, in turn, drives the fan 22, based on the received drive signal.

As the fan 22 is driven, air in the room is introduced into the interior of indoor unit 10 through an air inlet 12 and is then subjected to a heat exchange by the heat exchanger 20, so that it may be cooled. The cooled air is then continuously discharged through the air outlet 14 by the fan 22 to be introduced into the room again, as shown in FIG. 5.

At a step S3, the control unit 32 determines whether the present routine corresponds to a selected routine for driving the control louver. That is, the control unit 32 determines whether the louver position selected by the user corresponds to the present position of the control louver. Eventually, the louver is adjusted to a desired position in accordance with the selected louver position. That adjustment is made in step 17. Prior to step 17, however, a test procedure is performed to determine whether the movement of the louver occurs at a predetermined rate. If not, then it is unlikely that the louver can be accurately adjusted. The test procedure is performed in steps S5 through S15 as described hereinafter.

When a determination has been made at the step S3 that no control louver position (i.e., driving routine) has been selected, the air conditioner is operated in accordance with an operation mode selected by the user at a step S4.

In a case that the control louver driving routine has been selected, a step S5 is executed. At the step S5, a determination is made about whether the first switch 51 is turned on.

When the first switch 51 has been determined to be at its OFF state at the step S5, a step S6 is executed. When the first switch 51 is at its ON state, a step S7 is executed.

At the step S6, the control unit 42 generates a pulse signal for driving the horizontal control louver 16 and/or the vertical control louver 18 and sends it to the control louver driving unit 36. In response to the received pulse signal, the control louver driving unit 36 drives or rotates the step motor 30 and thereby the horizontal control louver 16 and/or the vertical control louver 18. Simultaneously with the outputting of the pulse signal to the control louver driving unit 36 at the step S6, the control unit 42 determines continuously whether the first switch 51 is turned on at the step S5. This procedure is repeated until the first switch 51 is turned on.

On the other hand, when the first switch 51 has been determined to be at its ON state at the step S5, the control unit 42 generates the pulse signal and sends it to the control louver driving unit 36 at the step S7. In response to the received pulse signal, the control louver driving unit 36 drives the step motor (not shown) and thereby the horizontal control louver 16 and/or the vertical control louver 18. Simultaneously with the outputting of the pulse signal to the control louver driving unit 36 at the step S7, the control unit 42 activates a timer (typically equipped in the control unit).

Subsequently, a determination is made at a step S9 about whether the second switch 53 is turned on. If the second switch 53 has been determined to be at its OFF state at the step S9, then the step S7 is continuously executed until the second switch 53 is turned on. If the second switch 53 has been determined to be at its ON state, then a step S11 is executed.

At the step S11, the activation of the timer begun at the step S7 is stopped. Thereafter, the time interval between the time point at which the first switch 51 is turned on and the time point at which the second switch 53 is turned on is determined as the time t1 taken for the control louver 16 to be driven.

At a subsequent step S13, the time t1 determined at the step S11 is compared with the reference time Tr. This reference time Tr corresponds to the time taken for each control louver 16 to be normally driven and is predetermined by the user or the manufacturer of the air conditioner.

When the time t1 has been determined to be more than the reference time Tr at the step S13, the drive force for the control louver 16 is increased at a step S15. That is, the control unit 42 determines the condition of the control louver 16 corresponding to the time t1 more than the reference time Tr as a condition that a torsion has occurred at the control louver or as a condition that a foreign matter has been caught in the control louver. Accordingly, the control unit 42 lowers the frequency of the pulse signal, thereby causing the drive force to be increased.

If the time t1 is less than or equal to the reference time Tr, then the control unit 42 determines the condition of the control louver as a normal condition. In this case, the drive force is kept at a normal level.

At a subsequent step S17, i.e. after the test procedure has been concluded, the horizontal control louver 16 and/or the vertical control louver 18 is driven by the drive force determined at the step S15 or the step S16 so that the louvers are adjusted to the selected position. Accordingly, the air discharged out of the outlet 14 by the fan 22 is introduced into the room while being controlled in direction by the horizontal control louver 16 and/or the vertical control louver 18.

Although the above description has been made in conjunction with the case wherein the first switch 51 and the second switch 53 are disposed respectively above and beneath the outlet 14 of the indoor unit, the object of the present invention may be equivalently accomplished even in a case wherein only one switch is disposed above or beneath the outlet 14. In this case, the step S9 of FIG. 6 is executed to determine whether the first switch is turned on. That is, a determination is made about whether the control louver is driven one rotation. At the steps S7 and S11, the time taken for the control louver to be driven one rotation is measured. This measured time is then compared with the reference time at the step S13. Of course, the reference time predetermined in this case is longer than the reference time Tr of the illustrated embodiment of the present invention.

As apparent from the above description, the control louver driving method and apparatus in accordance with the present invention achieve an accurate driving of the control louvers and thereby provide an effect of accurately controlling that the control louvers in accordance with the user's desire.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

Although the present invention has been described in conjunction with a case employing switches for sensing positions of the control louver, sensors other than the switches may be used for the same purpose.

In the above description, positions of the switches for sensing positions of the control louver have been illustrated in detail. However, these positions are intended to illustrate the invention and are not to be construed to limit the scope of the present invention.

Although the present invention has been described in conjunction with the preferred embodiments wherein the switches are disposed above and beneath the horizontal control louver to sense positions of the horizontal control louver, the switches may be disposed in both sides of the vertical control louver to sense positions of the vertical control louver. It is also possible to employ switches for both the horizontal control louver and the vertical louver.

In the illustrate preferred embodiments of the present invention, the step motor has been described as being employed as the motor for driving the control louver. However, motors other than the step motor may be used for the same purpose. In this case, control for the motor used may be more or less varied, depending on characteristic of the motor.

What is claimed is:

1. A method of adjusting the position of an air flow-directing louver of an air conditioner to change the direction of air flow, comprising the steps of:

A) generating a drive signal from a control unit in accordance with a user's selection of a louver position;

B) delivering the drive signal to a motor connected to the louver to produce a first drive force for moving the louver;

C) moving the louver for a predetermined distance from a first predetermined position to a second predetermined position under the first drive force while measuring the time for such movement to be completed, and comparing the measured time to a reference time, and increasing the first drive force to a second drive force in response to a condition wherein the measured time exceeds the reference time; and thereafter D) moving the louver to the user-selected louver position under the second drive force.

2. The method according to claim 1 wherein step D is performed after step C without stopping the louver movement.

3. The method according to claim 1, wherein step C further comprises sensing the departure of the louver from the first predetermined position and the arrival of the louver at the second predetermined position by sensing means.

4. The method according to claim 1, wherein moving the louver a predetermined distance in step C comprises moving the louver away from a predetermined position and then back to the predetermined position.

5. The method according to claim 1, wherein step A comprises generating an electric drive signal having a first frequency; step B comprising feeding the electric drive signal to an electric stepping motor; step C comprising reducing the frequency of the electric drive signal to a second frequency to increase the drive force to the motor.

6. The method according to claim 1, wherein in each of steps B through D the moving of the louver comprises rotating the louver about a horizontal axis.

7. The method according to claim 1, wherein in each of steps B through D the moving of the louver comprises rotating the louver about a vertical axis.

8. An air conditioner comprising:

a housing defining an air flow path having an air inlet and an air outlet;

a heat exchanger disposed in the air flow path;

a fan mounted to the housing for generating an air flow along the air flow path and into heat exchanging relationship with the heat exchanger;

a louver disposed at the air outlet for directing the discharged air, the louver being movable between different positions for changing the direction of the discharged air;

a motor connected to the louver for moving the louver;

a control mechanism including:

a selector enabling a user to select a louver position, a drive signal generator for generating a drive signal in accordance with the selected louver position and feeding the drive signal to the motor to produce a first drive force for adjusting the louver position, means for measuring a time for the louver to move a predetermined distance, comparing the measured time with a reference time, and increasing the first drive force to a second drive force in response to the measured time being greater than the reference time, and sensing means for sensing the movement of the louver by the predetermined distance from a first predetermined position to a second predetermined position.

9. The air conditioner according to claim 8, wherein the sensing means comprises first and second position sensors spaced apart along a path of travel of the louver.

10. The air conditioner according to claim 8, wherein the sensing means is arranged to be contacted by the louver.

* * * * *